US007338139B2

(12) United States Patent
Peter

(10) Patent No.: US 7,338,139 B2
(45) Date of Patent: Mar. 4, 2008

(54) CABINET APPARATUS FOR KITCHEN UTENSILS AND APPLIANCES

(76) Inventor: Linda R. Peter, 51057 155th St., Austin, MN (US) 55912

( * ) Notice: Subject to any disclaimer, the term of this patent is extended or adjusted under 35 U.S.C. 154(b) by 272 days.

(21) Appl. No.: 10/864,932

(22) Filed: Jun. 9, 2004

(65) Prior Publication Data

US 2005/0275320 A1 Dec. 15, 2005

(51) Int. Cl.
*A47B 77/00* (2006.01)

(52) U.S. Cl. ..... 312/107; 312/237

(58) Field of Classification Search ..... 312/107, 312/108, 236, 237, 195, 196, 203, 223.1, 312/351, 109, 330.1; 108/193, 180, 149
See application file for complete search history.

(56) References Cited

U.S. PATENT DOCUMENTS 542,341 A * 7/1895 Little ..... 312/198
901,887 A * 10/1908 Connaty ..... 312/203
1,066,006 A * 7/1913 Foltz ..... 312/210.5
1,081,151 A * 12/1913 Ritter ..... 312/210.5
1,438,713 A * 12/1922 Murchison ..... 312/228
1,668,232 A * 5/1928 Coppes ..... 312/203
1,670,028 A * 5/1928 Eustis et al. ..... 312/107
1,763,306 A * 6/1930 Hendrickson ..... 312/107
1,984,523 A * 12/1934 Ebbitt ..... 312/236
2,000,981 A * 5/1935 Parsons ..... 312/228
2,143,239 A * 1/1939 Foltz ..... 62/384
D153,094 S * 3/1949 Armbruster ..... D23/272
2,721,497 A * 10/1955 Warren ..... 396/332
3,259,446 A * 7/1966 Harle et al. ..... 312/296
3,364,695 A * 1/1968 Saunders et al. ..... 62/382
3,523,716 A * 8/1970 Salvatore, Jr. et al. ... 312/265.3
4,245,871 A * 1/1981 Rex ..... 312/7.2
D315,262 S * 3/1991 Denningham ..... D6/438
5,572,984 A * 11/1996 Alden et al. ..... 126/299 R
D492,510 S * 7/2004 Greenburg ..... D6/466
6,796,622 B2 * 9/2004 Nielsen ..... 312/205

FOREIGN PATENT DOCUMENTS

JP 401027507 * 1/1889

* cited by examiner

*Primary Examiner*—Janet M. Wilkens
(74) *Attorney, Agent, or Firm*—Merchant & Gould P.C.

(57) ABSTRACT

A cabinet apparatus for the efficient and safe organization, storage and use of kitchen appliances and utensils, particularly in a relatively small amount of space. The cabinet includes a bottom portion for holding a miniature refrigerator. A middle portion includes a drawer for holding utensils and a retractable and removable cutting board. The middle portion also includes a shelf for placement of a microwave, coffee pot or other items. The top portion of the cabinet includes shelves that provide additional storage space.

10 Claims, 2 Drawing Sheets

CABINET APPARATUS FOR KITCHEN UTENSILS AND APPLIANCES

FIELD OF THE INVENTION

This invention relates generally to a cabinet for the safe and efficient organization, storage and use of kitchen utensils and appliances; and more particularly to a standing cabinet to be utilized in relatively small spaces for such purposes.

BACKGROUND OF THE INVENTION

Persons living in relatively small spaces such as dorm rooms need an efficient and safe way to organize, store and utilize kitchen utensils and appliances. Efficient storage of kitchen items is also important in offices, conference rooms, garages, basements, cabins, or anywhere that it is desired to store and use kitchen equipment without using a full-kitchen space.

While a variety of cabinets and shelving exists for efficient use of space, there are a number of shortcomings that limit the usefulness of existing cabinets. For example, existing cabinets are not well suited for containing all the necessary or desired kitchen elements. Also, existing cabinets are cumbersome to build and large in size, taking up unnecessary amounts of space that is at a premium in dorm rooms and the like. Because existing cabinets are not well suited for holding all of these items, they can be unsafe when their uses are extended beyond their capabilities.

There is a need for a cabinet system that provides a safe, organized, and convenient means for holding and storing various common kitchen appliances, utensils, and the like. Moreover, there is a need for such a cabinet system that is capable of providing storage and holding areas for these appliances, while providing a small footprint that does not take up unnecessary space in the user's home or office.

The present invention is directed at solving these shortcomings by providing a safe way to contain, hold, and use numerous kitchen appliances and utensils in an orderly, organized and ready-to-use manner in a small amount of space. The present invention also provides a cabinet system that allows for easy and efficient use of the kitchen equipment contained and held by the cabinet system. Moreover, the cabinet system of the present invention provides a user-friendly and workable combination of a number of functions, including a working space and appliance holding areas, such as is not currently available.

SUMMARY OF THE INVENTION

In accordance with the invention, the above and other desires and needs are met by providing a cabinet apparatus to efficiently and safely store, organize and use kitchen appliances and utensils, while also enabling the use of the appliances and utensils in a relatively small amount of space.

In a preferred embodiment constructed according to the principles of the present invention, a cabinet apparatus includes a bottom portion to hold a miniature refrigerator. The middle portion of the cabinet includes a drawer to store utensils, and a retractable cutting board. This middle portion also includes shelving and space for a microwave or other items of the user's choice. The top portion includes shelved cupboard space for additional storage.

In one embodiment of the present invention a kitchen storage apparatus for receiving and holding various kitchen components is provided. The apparatus has a bottom portion having a compact refrigerator receiving area that is configured to receive a compact refrigerator; a middle portion located above the bottom portion, the middle portion including a counter, a drawer, and a removable cutting board; and a top portion that includes shelves for storage. The apparatus is configured such that the cutting board can be recessed into the cabinet apparatus when the cutting board is not in use.

In another embodiment of the present invention, a cabinet storage system is provided. The system has two opposing side members, the side members running the height of the cabinet system. The system also has a top member and a bottom member, with the top and bottom members connecting the side members at a top and a bottom of the cabinet system, respectively. A counter connects the side members at an area of the cabinet system that is between the top and bottom members. A kitchen appliance receiving space is located between the counter and the bottom member and is configured to receive a compact refrigerator or other kitchen appliance.

In yet another embodiment of the present invention, a cabinet storage system for storing kitchen equipment is provided. Two opposing side members run the height of the cabinet system. A top member and a bottom member connect the side members at a top and a bottom of the cabinet system, respectively. A counter connects the side members at an area of the cabinet system that is between the top and bottom members. At least one shelf is formed between the side members at an area of the cabinet system that is between the top member and the counter. At least one drawer is disposed between the side members at an area of the cabinet that is between the counter and the bottom member. A kitchen appliance receiving space located between the counter and the bottom member is configured to receive a compact refrigerator.

Thus, the cabinet apparatus of the present invention provides a convenient, safe, and highly organized system in a relatively small amount of space. These and various other advantages and features which characterize the invention are pointed out with particularity in the claims annexed hereto and forming a part hereof. However, for a better understanding of the invention, its advantages and objectives obtained by its use, reference should be had to the drawings which form a further part hereof and to the accompanying descriptive matter, in which there is illustrated and described a preferred embodiment to the invention.

BRIEF DESCRIPTION OF THE DRAWINGS

Referring to the drawings wherein like numerals represent like parts throughout the several views.

DETAILED DESCRIPTION OF THE PREFERRED EMBODIMENT

The present invention provides for an efficient way to organize, store and utilize numerous kitchen appliances and utensils in a relatively small space, such as a dorm room or efficiency apartment.

In the following description of the exemplary embodiment, reference is made to the accompanying drawings which form a part hereof, and in which is shown by way of illustration the specific embodiment in which the invention may be practiced. It is to be understood that other embodiments may be utilized when structural and other changes may be made without departing from the scope of the present invention.

The cabinet is an all-in-one container to make it easy and convenient to have many of one's kitchen appliances available to a user whose accommodations don't allow for much space. The cabinet holds these appliances so that they are available in a safe and organized way. Having various appliances stacked and piled precariously about a space is not safe. This invention provides a safer environment for their storage.

The invention is an all-in-one storage device, providing, for example, spaces to hold a miniature refrigerator; a retractable and removable cutting board; a drawer for utensil storage; a shelf or counter top for a microwave, coffee pot, or other items; and additional storage areas for food, dinnerware, and other items.

Figure 1:
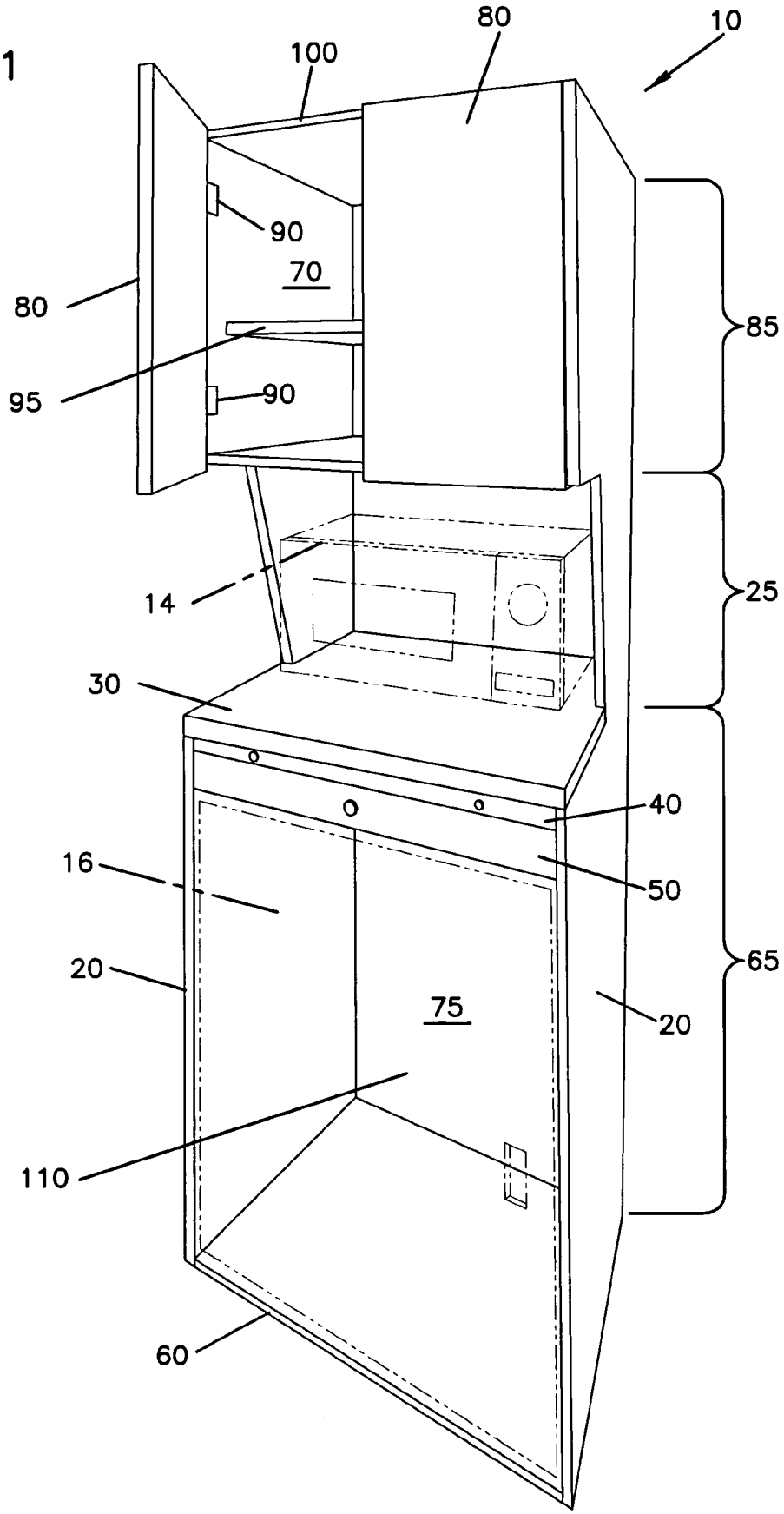
FIG. 1 is a perspective view of an embodiment of a kitchen cabinet apparatus in accordance with the present invention.

Referring to FIG. 1, the cabinet 10 is a one-piece unit. For purposes of example only, FIG. 1 shows a microwave oven 14 and compact refrigerator 16 in phantom lines. These appliances, for example, could be conveniently stored in the cabinet 10.

Side members 20 extend the height of the cabinet. Side members 20 are preferably formed from laminated particleboard. Particleboard is preferred because it is both sturdy and relatively inexpensive, thereby allowing for a cost-effective, heavy-duty construction. The heavy-duty construction of the cabinet 10 allows the unit to be used for a number of years without replacement. In the case of a dormitory, the heavy-duty construction allows the unit to be passed on to a new user on a yearly basis.

As shown in FIG. 1, side members 20 are preferably notched in a middle portion 25. A counter 30 rests on a lower area of the notched section. Counter 30 rests on both side members 20 and is preferably secured thereto by a suitable means, such as screws. Of course, counter 30 could be secured to the side members by nails, glue, or other known mechanical means. The notched portion also preferably extends from the counter 30 to the bottom of a top portion 85 (discussed below) of the cabinet. By extending the notch portion in this manner, a user of the cabinet is provided with better access to the counter 30. In other words, the notched portion allows a user of the cabinet 10 to reach items stored or placed upon counter 30 from the side of the cabinet 10 as well as from the front. However, the width of the side members 20 at the notch section should be sufficient to maintain the structural integrity of the unit.

The shape of the notch can vary and does not have to be formed as shown in FIG. 1. In addition, side members 20 could also be formed without notches. In other words, side members 20 could be of constant width (i.e., the depth of the cabinet 10) throughout their length. Such a configuration would limit access to the counter 30 from the sides; however, it would impart greater structural strength to the cabinet 10.

The counter 30 provides a countertop space that can be conveniently used in any number of ways. The counter 30, for example, is large enough to place a microwave on, a coffee pot, and/or other items of the user's choice. The countertop preferably has a Formica finish, which is both easy to clean and sturdy; thereby providing a convenient surface to work on or use for storage of appliances. Alternatively, the countertop could have another finish or surface coating that is similar to Formica in that it is durable and easy to clean.

Figure 2:
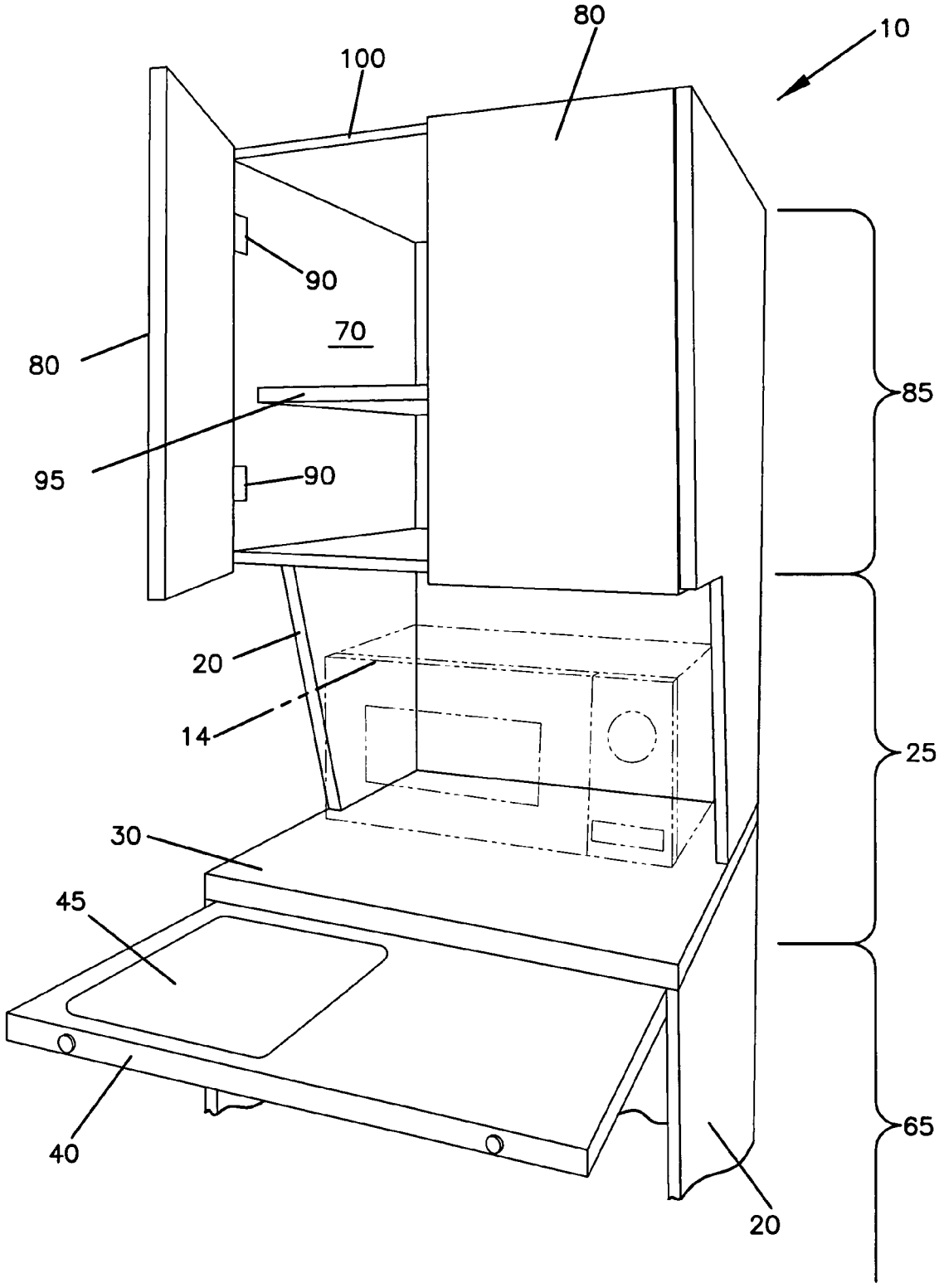
FIG. 2 is a partial perspective view of an embodiment of a kitchen cabinet apparatus in accordance with the present invention.

In a preferred embodiment, beneath the counter 30, the cabinet 10 has a retractable cutting board 40 built into it. The cutting board 40 has an easy-to-clean surface, such as vinyl. The vinyl surface could be included in a cutting area surface 45, such as shown in FIG. 2. The cutting board is also preferably removable for ease of cleaning. The cutting board 40 could also be used for additional workspace, for example, when preparing food or performing other tasks that may require additional countertop space. Both the counter 30 and the cutting board 40 could be used as workspace at the same time, thereby providing ample space to work.

In a preferred embodiment, beneath the cutting board 40 is a drawer unit 50. Drawer unit 50 provides convenient storage for various kitchen items, such as utensils, or other such things.

The bottom portion 65 of the cabinet provides a space for holding a compact refrigerator. The cabinet 10 includes a base member 60 that extends across the bottom of the cabinet 10 between side members 20. The area defined between the base member 60, drawer 50, and side members 20 is designed to accommodate a compact refrigerator. This space, however, could also be used to accommodate other desired appliances or items.

Compact refrigerators are often used by individuals who reside in smaller residences, such as dorm rooms or apartments. Compact refrigerators are refrigerators that have a storage capacity typically between about 2.5 cu. ft. and 4.9 cu. ft. Compact refrigerators of this size are generally dimensioned in the following ranges. The height of the compact refrigerator is generally between about 20 inches and 42 inches, the width between about 17 inches and 28 inches, and the depth between about 17 to 28 inches.

The compact refrigerator holding area 75 is configured to be slightly larger than that of the compact refrigerator, thereby allowing the compact refrigerator to fit within the base portion of the cabinet 10. Accordingly, the height of the compact refrigerator holding area 75 is generally between about 21 inches and 43 inches, and the width between about 18 inches and 29 inches. The depth of the cabinet member can be greater than that required by the compact refrigerator, though it is preferably not less than the depth of the refrigerator. Accordingly, the depth of the compact refrigerator holding area 75 is preferably greater than 18 inches, and more preferably greater than 22 inches, and even more preferably greater than 26 inches.

In a preferred embodiment, a top portion 85 of the cabinet includes a cupboard 70 for storage. The cupboard 70 may include doors 80 to enclose the storage space provided within cupboard 70. Hinges 90 are attached to side members 20 and doors 80 to allow for easy access to the inside of the cupboard 70. Moreover, one or more shelves 95 can be provided within the cupboard 70 to provide for convenience storage of items, such as glassware, plates, food items, or the like. Shelves 95 can be removable or relocatable in the cupboard 70. A top member 100 is provided across the top of the cupboard 70, thereby enclosing the storage space of the cupboard 70.

The cabinet 10 may also include a rear member 110 which covers the rear surface of the cabinet 10. Rear member 110 may be a one-piece member, or if desired, it could be formed of more than one members. For example, rear member 110 could be formed in three pieces, one for each of the top portion 85, middle portion 25, and bottom portion 65. In a preferred embodiment, rear member 110 is a one-piece member that covers the rear area of the top portion 85, middle portion 25, and bottom portion 65 of cabinet 10; thereby extending the entire height of the cabinet 10.

Alternatively, rear member 110 may be constructed so that it does not cover the rear area of the compact refrigerator holding area 75. Because refrigerators generate heat, it may be preferable to leave the rear area of the compact refrigerator holding area open.

Rear member 110 preferably is provided with preformed openings so that cords or other electric wires can exit through rear member 110 to an electrical unit behind the cabinet 10. The preformed openings may be holes, or they may simply be perforated areas that are easily converted to openings by the user of the cabinet 10. Preformed openings are preferred in middle portion 25 of the cabinet 10, because this area may accommodate electrical appliances, such as a microwave oven or coffee pot. In addition, if the rear member 110 extends behind the compact refrigerator holding area, preformed openings are preferably formed in the rear member in that area as well, since the refrigerator plug will preferably exit the rear of the cabinet 10.

The parts of the cabinet 10 (i.e., side members 20, base member 60, top member 100) are preferably formed of the same material, such as particleboard. Of course, other suitable materials could be used for the side members or the rest of the cabinet 10 without departing from the scope of the invention. For example, the cabinet 10 could be constructed of wood, plastic, or even metal.

In a preferred embodiment, side members 20 extend or run the length of the cabinet. This means that the length of the side members 20 would be substantially the length of the cabinet 10, depending on whether top member 100 and bottom member 60 are attached between the side members 20 or on top of or below side members 20. However, it may be desirable to form the side members into two or more sections. For example, a top portion 85 and middle portion 25 of the cabinet 10 may be separately formed from the bottom portion 65 and then attached to the bottom portion 65 of the cabinet 10. In such a case, the side members 20 would be formed into two separate elements, as shown in FIG. 2.

The cabinet 10 is generally sized and constructed so that it is relatively light in weight and portable. To increase the portability and mobility of the cabinet 10, the cabinet 10 can include heavy-duty caster wheels secured to the bottom of the cabinet 10. Therefore, one could easily move the cabinet 10 throughout the home, or from one remote location to another, without having to remove all of the appliances and stored materials to lighten the cabinet 10 before moving it. This may be particularly useful in office spaces, conference rooms, or any other location where the user wishes to store the cabinet 10 in an area separate from the area of use of the cabinet 10. For example, an office may wish to move the cabinet 10 from one space to another for use during a meeting or a convention.

As noted above, the present invention is ideal for an environment such as a dorm room, but could be considered for such uses as a mini-kitchen in an office, cabin, family room, garage, craft room, break room at work, hotels that are not already equipped with kitchen service, ice houses equipped with a generator, or a campsite with electricity available. It fits in a relatively small area, is easy to maneuver with heavy-duty casters, and can serve as a wholly self-contained kitchen.

While a particular embodiment of the invention has been described with respect to its application for storing and utilizing kitchen appliances and utensils, it will be understood by those of skill in the art that the invention is not limited by such application or embodiment for the particular components disclosed and described herein. It will be appreciated by those skilled in the art that other configurations that embody the principles of this invention and other applications therefor can be configured within the spirit and intent of this invention. The configuration described herein is provided as only example(s) of an embodiment(s) that incorporate(s) and practice(s) the principles of this invention. Other modifications and alterations are well within the knowledge of those skilled in the art and are to be included within the broad scope of the appended claims.

What is claimed is:

1. A cabinet storage system, the system comprising:

two opposing side members, the side members running the height of the cabinet system;

a top member and a bottom member, the top and bottom members connecting the side members at a top and a bottom of the cabinet system, respectively; and a counter connecting the side members at an area of the cabinet system that is between the top and bottom members;

a first kitchen appliance receiving space defined between the counter and the bottom member, the first kitchen appliance receiving space being configured to receive a compact refrigerator;

a second kitchen appliance receiving space defined between the counter and the top member, the second kitchen appliance receiving space being configured to receive a microwave, the counter defining a support surface upon which the microwave is supported;

at least one shelf positioned between the second kitchen appliance receiving space and the top member;

at least one drawer positioned between the first kitchen appliance receiving space and the counter; and a rear member that covers a back area of the cabinet system only between the counter and the top member;

wherein the first and second kitchen appliance receiving areas, the at least one shelf, and the at least one drawer are all aligned vertically, a maximum height of the cabinet system is greater than a maximum width of the cabinet system, and a maximum width of the cabinet system is substantially equal to a width of the first kitchen appliance receiving area plus a material thickness of each of the opposing side members.

2. The cabinet system according to claim 1, wherein the first kitchen appliance receiving space is configured to be between 21 inches and 43 inches high, and between 18 inches and 29 inches wide.

3. The cabinet system according to claim 1, wherein the first and second kitchen appliance receiving spaces have substantially the same width.

4. The cabinet system according to claim 1, further including a plurality of wheels provided beneath the cabinet system to increase the ease of mobility of the cabinet system.

5. The cabinet system according to claim 1, wherein the side members are notched in the vicinity of the counter, thereby providing access to the counter from the side of the cabinet system.

6. The cabinet system according to claim 5, wherein a cutting board is provided in the cabinet system between the side members and beneath the counter, the cabinet system receiving the cutting board into an inner area of the cabinet system, and the cutting board being removable from the cabinet system.

7. The cabinet system according to claim 1, wherein the at least one shelf is enclosed in a cupboard, the cupboard having doors that enclose the at least one shelf.

8. The cabinet system according to claim 1, wherein the rear member includes pre-formed holes for allowing electrical cords to pass through the rear member from the first kitchen appliance receiving space and through the rear member from the second kitchen appliance receiving space.

9. A cabinet storage system for storing kitchen equipment, the system comprising:

two opposing side members, the side members extending a height of the cabinet system, each side member including an outward facing primary surface and an inward facing primary surface;

a top member and a bottom member, the top and bottom members connecting the side members at a top and a bottom of the cabinet system, respectively;

a counter connecting the side members at an area of the cabinet system that is between the top and bottom members;

at least one shelf formed between the side members at an area of the cabinet system that is between the top member and the counter, the at least one shelf having a width; and at least one drawer disposed between the side members at an area of the cabinet that is between the counter and the bottom member, the at least one drawer having a width;

a first kitchen appliance receiving space defined between the counter and the bottom member, the first kitchen appliance receiving space having a width and a height and being configured to receive a compact refrigerator, the width of the first kitchen appliance receiving space being substantially the same as the width of the drawer and the width of the at least one shelf; and a rear member covering a back area of the cabinet system only between the counter and the top member, the rear member includes at least one pre-formed hole configured to permit electrical cords to pass through the rear member from the first kitchen appliance receiving space;

wherein a width of the cabinet system is equal to a width of the first kitchen appliance receiving area plus a material thickness of each of the side members measured between the outward and inward primary facing surfaces.

10. The cabinet storage system according to claim 9, wherein the first kitchen appliance receiving space is configured to be between 21 inches and 43 inches high, and between 18 inches and 29 inches wide.

* * * * *